US010053908B2

(12) United States Patent
Gower

(10) Patent No.: US 10,053,908 B2
(45) Date of Patent: Aug. 21, 2018

(54) BARRIER WITH REGION OF INCREASED THICKNESS

(71) Applicant: Ted Gower, North Palm Beach, FL (US)

(72) Inventor: Ted Gower, North Palm Beach, FL (US)

( * ) Notice: Subject to any disclaimer, the term of this patent is extended or adjusted under 35 U.S.C. 154(b) by 0 days.

(21) Appl. No.: 15/369,882

(22) Filed: Dec. 5, 2016

(65) Prior Publication Data

US 2017/0081910 A1 Mar. 23, 2017

Related U.S. Application Data

(63) Continuation of application No. 14/561,415, filed on Dec. 5, 2014, now Pat. No. 9,512,612.

(51) Int. Cl.

| | |
|---|---|
| ***E06B 9/06*** | (2006.01) |
| ***E04B 1/41*** | (2006.01) |
| ***E06B 9/02*** | (2006.01) |
| ***E06B 9/40*** | (2006.01) |
| ***E06B 9/58*** | (2006.01) |
| *E06B 9/00* | (2006.01) |

(52) U.S. Cl.

CPC ..... *E06B 9/0692* (2013.01); *E04B 1/40* (2013.01); *E06B 9/02* (2013.01); *E06B 9/40* (2013.01); *E06B 9/581* (2013.01); *E06B 2009/005* (2013.01)

(58) Field of Classification Search

CPC .... E06B 9/02; E06B 2009/005; E06B 9/0692; E06B 9/581; E04B 1/40

See application file for complete search history.

(56) References Cited

U.S. PATENT DOCUMENTS

| | | | | | |
|---|---|---|---|---|---|
| 2,287,667 | A * | 6/1942 | Brown | E04F 10/02 | 16/87.4 R |
| 3,862,876 | A * | 1/1975 | Graves | E04G 21/28 | 150/901 |
| 3,911,631 | A * | 10/1975 | Cooper | E04H 15/22 | 24/546 |
| 4,103,401 | A * | 8/1978 | Conley | F16B 5/0692 | 160/392 |
| 4,105,127 | A * | 8/1978 | Holl | A47G 1/21 | 211/124 |
| 4,234,035 | A * | 11/1980 | Babbs | A47C 31/023 | 160/392 |

(Continued)

*Primary Examiner* — Babajide A Demuren
(74) *Attorney, Agent, or Firm* — Darrow Mustafa PC

(57) ABSTRACT

A barrier includes a main body, a first edge region, and a second edge region. The first edge region can include a first bulging element, and the second edge region can include a second bulging element. The first and second edge regions can be on opposite sides of the barrier and can extend substantially parallel to each other. The main body of the barrier can include one or more regions of increased thickness. The region(s) of increased thickness can be in an intermediate location between the first bulging element and the second bulging element. The region(s) of increased thickness can be spaced from the first edge region and the second edge region such that the region(s) of increased thickness do not contact the first bulging element or the second bulging element. The main body, the first bulging element, and the second bulging element can be configured to be rolled.

18 Claims, 11 Drawing Sheets

(56) References Cited

U.S. PATENT DOCUMENTS

| | | | | | |
|---|---|---|---|---|---|
| 4,571,897 | A * | 2/1986 | Kerr | E04D 3/28 | 52/13 |
| 4,629,433 | A * | 12/1986 | Magid | A47C 27/081 | 441/129 |
| 4,825,921 | A * | 5/1989 | Rigter | E06B 9/54 | 160/23.1 |
| 5,174,073 | A * | 12/1992 | Sabo | F41H 3/00 | 135/88.11 |
| 5,259,323 | A * | 11/1993 | Koch | B60D 5/003 | 105/20 |
| 6,176,050 | B1 * | 1/2001 | Gower | E04H 9/14 | 135/115 |
| 7,464,506 | B2 * | 12/2008 | Atkinson | E04H 9/14 | 52/2.11 |
| 2005/0279465 | A1 * | 12/2005 | Gower | E06B 9/02 | 160/368.1 |
| 2006/0260226 | A1 * | 11/2006 | Gower | E06B 9/02 | 52/202 |
| 2007/0227084 | A1 * | 10/2007 | Skobba | E06B 9/02 | 52/202 |
| 2008/0078131 | A1 * | 4/2008 | Grimes | E06B 9/02 | 52/202 |
| 2008/0141599 | A1 * | 6/2008 | Akdag | E06B 9/08 | 52/202 |
| 2011/0049071 | A1 * | 3/2011 | Hart | E06B 9/48 | 211/124 |

* cited by examiner

BARRIER WITH REGION OF INCREASED THICKNESS

CROSS-REFERENCE TO RELATED APPLICATIONS

This application is a continuation of U.S. patent application Ser. No. 14/561,415, filed on Dec. 5, 2014, which is incorporated herein by reference in its entirety.

FIELD

Arrangements relate in general to barriers and, more particularly, to the deployment and/or storage of barriers.

BACKGROUND

Barriers can be used to protect objects, structures, people and/or other things located in the area behind the barrier. For example, hurricane shutters can be used during hurricanes, tornados, windstorms or other conditions in which high wind velocities are present. In such cases, hurricane shutters can be removably installed over a frangible area of a structure. The hurricane shutters can protect the frangible area from objects carried by the wind and/or the force of the wind itself. It is desirable for hurricane shutters to be relatively rapidly and easily installed, removed and/or stored.

SUMMARY

In one respect, the subject matter described herein is directed to a barrier. The barrier can include a main body, a first edge region, and a second edge region. The first edge region can define a first side of the barrier, and the second edge region can define a second side of the barrier. The first edge region can include a first bulging element, and the second edge region can include a second bulging element. The first edge region and the second edge region can be on opposite sides of the barrier and can extend substantially parallel to each other. The main body of the barrier can include one or more regions of increased thickness. The one or more regions of increased thickness can be in an intermediate location between the first bulging element and the second bulging element. The one or more regions of increased thickness can be spaced from the first edge region and the second edge region such that the one or more regions of increased thickness do not contact the first bulging element or the second bulging element. The main body, the first bulging element, and the second bulging element can be configured to be rolled.

In another respect, the subject matter described herein is directed to a barrier system. The barrier system can include a spindle and a barrier. The spindle can be rotatable about an axis of rotation. A portion of the barrier can be attached to the spindle. The barrier can be configured to be selectively rolled onto or rolled from the spindle. In a stored configuration, the barrier can be rolled onto the spindle. In a deployed configuration, at least a portion of the barrier can be unrolled from the spindle.

The barrier can have a main body, a first edge region, and a second edge region. The first edge region can define a first side of the barrier. The first edge region can include a first bulging element. The second edge region can define a second side of the barrier. The second edge region can include a second bulging element. The first edge region and the second edge region can be being on opposite sides of the barrier. The first edge region and the second edge region can extend substantially parallel to each other.

The main body of the barrier can include one or more regions of increased thickness. The one or more regions of increased thickness can be located in an intermediate location between the first bulging element and the second bulging element. The one or more regions of increased thickness can be spaced from the first edge region and the second edge region. In some arrangements, the one or more regions of increased thickness do not contact the first bulging element or the second bulging element.

In still another respect, the subject matter described herein is directed to a barrier system. The system includes a retainer and a barrier. The retainer has a body that includes a cavity and an opening. The opening can permit communication between the cavity and the outside of the retainer.

The barrier includes a main body, a first edge region, and a second edge region. The first edge region can define a first side of the barrier. The first edge region can include a first bulging element. The second edge region can define a second side of the barrier. The second edge region can include a second bulging element. The first edge region and the second edge region can be on opposite sides of the barrier. The first edge region and the second edge region can extend substantially parallel to each other, The main body of the barrier can include one or more regions of increased thickness. The one or more regions of increased thickness can be located in an intermediate location between the first bulging element and the second bulging element. The one or more regions of increased thickness can be spaced from the first edge region and the second edge region. The one or more regions of increased thickness do not contact the first bulging element or the second bulging element. The main body can have an associated width. The one or more regions of increased thickness can have an associated width. The width of the one or more regions of increased thickness can be less than about 50% of the width of the main body.

At least a portion of the first edge region of the barrier, including the bulging element, can be received in the cavity in the retainer. The barrier can pass through the opening in the retainer. In this way, the barrier can be retainably engaged in the retainer.

DETAILED DESCRIPTION

Arrangements described herein relate to systems, methods, apparatus and/or devices for use in connection with barriers and/or retainers for barriers. Detailed embodiments are disclosed herein; however, it is to be understood that the disclosed embodiments are intended only as exemplary. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of embodiments and aspects herein. Arrangements are shown in FIGS. 1-14, but the embodiments are not limited to the illustrated structure(s) or application(s).

For purposes of simplicity and clarity of illustration, elements shown in the figures have not necessarily been drawn to scale. For example, the dimensions of some of the elements may be exaggerated relative to other elements for clarity. Further, where considered appropriate, reference numbers are repeated among the figures to indicate corresponding, analogous, or like features. In addition, numerous specific details are set forth in order to provide a thorough understanding of the embodiments described herein. However, it will be understood by those of ordinary skill in the art that the embodiments described herein can be practiced without these specific details.

Figure 1:
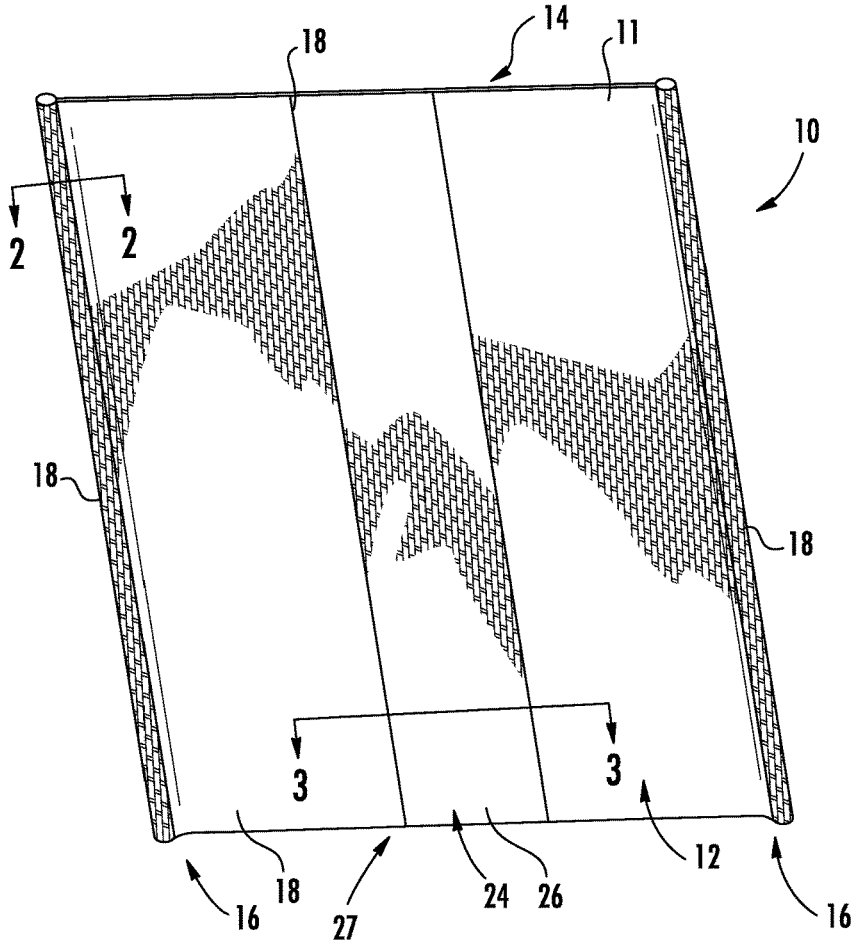
FIG. 1 is an example of a barrier.

Referring to FIG. 1, one or more arrangements herein can include a barrier 10. As used herein, a "barrier" is defined as any physical structure that prevents, blocks, hinders, obstructs, bars, minimizes and/or impedes the passage of a force, object and/or thing through it. The barrier can be a manmade physical structure, that is, a structure that is manufactured, created, constructed or built by humans, as opposed to occurring in nature. The particular embodiments described herein are directed to a barrier that can protect at least a portion of a structure (e.g. a habitable structure, a non-habitable structure, hotel, restaurant, etc.), at least a portion of an object (e.g. furniture, decorations, artwork, sculptures, toys, tools, equipment, etc.), and/or at least a portion of a thing from the force of winds (e.g. hurricanes, tornadoes, etc.) and from impact of objects and things carried by such winds (e.g. sand, rain, debris, vegetation, etc.).

However, it will be understood that embodiments are not limited to these applications. Indeed, alternatively or in addition, the barrier can be used to shield at least a portion of a structure, people, animals and/or things from the sun, rain and other elements. Further alternatively or in addition, the barrier can be used to provide privacy. Still further alternatively or in addition, the barrier can be used to keep animals (e.g. insects) out of a structure or an area. Still further alternatively or in addition, the barrier can be used to modify the environment within at least a portion of a structure and/or the environs around at least a portion of a structure to make it more comfortable. For instance, the barrier can be used to reduce temperature, dampen sound and/or prevent rain entry. In some arrangements, one or more barriers can be used on the inside of a structure and/or in an indoor environment. In other arrangements, one or more barriers can be used on the outside of a structure and/or in an outdoor environment.

Any suitable material can be used for the barrier 10. In one or more arrangements, the barrier 10 can have a main body 11. The main body 11 can include by one or more body elements (e.g. one or more panels of material). The main body 11 can include one or more layers. The barrier 10 can be flexible. In one or more arrangements, the barrier 10 can be made of a material that enables the barrier to be rolled, coiled and/or folded for storage or other purposes.

The barrier 10 can have any suitable size, shape and/or thickness. In one or more implementations, the barrier 10 can be substantially rectangular. As used herein, the term "substantially" includes exactly the term it modifies and slight variations therefrom. Thus, the term "substantially rectangular" means exactly rectangular and slight variations therefrom. While arrangements presented herein will be described in connection with a substantially rectangular barrier, it will be understood that the barrier is not limited to such a shape. Indeed, other shapes for barrier 10 are possible. For instance, barrier 10 can be substantially triangular, substantially square, substantially polygonal, substantially trapezoidal, substantially circular, substantially oval, substantially parallelogram, or substantially rhombus, just to name a few possibilities. Further, the barrier 10 can be any irregular shape. The barrier 10 can be symmetrical. Alternatively, the barrier can be asymmetrical.

In one or more implementations, the barrier 10 can be made from a textile woven of a suitable fiber. As an example, the barrier 10 can be made of polypropylene formed in a monofilament and woven into geotextile, such as style 20458 manufactured by Synthetic Industries of Gainesville, Ga. Various examples of suitable materials for the barrier and associated characteristics and/or properties are described in U.S. Pat. Nos. 6,176,050; 6,325,085; 6,886,299; 6,865,852; 8,393,055; 8,082,970; and 8,505,263 and U.S. Patent Application Publication Nos. 2005/0279465 and 2013/0186008, which are incorporated herein by reference. In one or more arrangements, the barrier 10 can be a made of a flexible material. In one or more arrangements, the barrier 10 can be made of a rigid material.

The barrier 10 can include an outer side 12 and an inner side 14. The terms "inner" and "outer" are used relative to the subject being shielded by the barrier 10. Thus, the inner side 14 can face toward a structure, object, person and/or thing being shielded by the barrier 10, and the outer side 12 can face away from the structure, object, person and/or thing being shielded by the barrier 10. The barrier 10 can have one or more sides 18. The barrier 10 can include one or more edge regions 16. Each edge region 16 can include a respective one of the sides 18. In the case of a substantially rectangular barrier, as is shown in FIG. 1, the barrier 10 can have four sides 18 and four edge regions 16.

At least one of the edge regions 16 can be configured to be retainably engaged by a retainer element. "Retainably engaged" and variants thereof means any direct or indirect engagement such that the items are held in a desired position relative to each other. In this way, the barrier 10 can be held in a desired place.

In one or more implementations, the barrier 10 can have a pair of opposing edge regions 16 configured to be retainably engaged by a retainer element. One example of such an arrangement is shown in FIG. 1. While the description herein will be primarily directed to such an arrangement, it will be understood that embodiments are not limited to this arrangement. Indeed, in some implementations, the barrier 10 may include only one edge region 16 configured to be retainably engaged by a retainer element. Alternatively, in some implementations, the barrier 10 can include more than two edge regions 16 configured to be retainably engaged by a retainer element. Still further, in one or more implementations, the barrier 10 can include non-opposing edge regions 16 configured to be retainably engaged by a retainer element.

Figure 2:
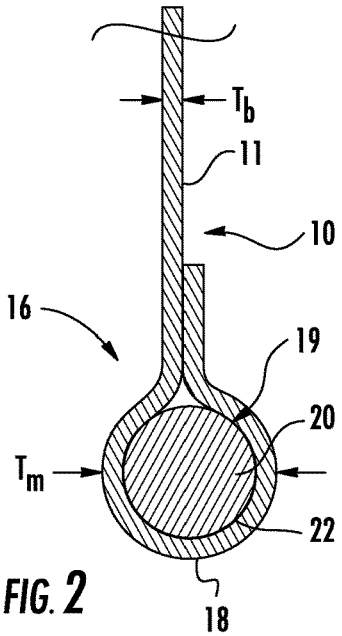
FIG. 2 is a cross-sectional view of an example of an edge region of a barrier, viewed along line 2-2 in FIG. 1.

The edge regions 16 can be configured to be retainably engaged by a retainer element in any suitable manner. As an example, at least one of the edge regions 16 can include a bulging element 19. In one or more implementations, the bulging element 19 can be a cord-like member 20. The cord-like member 20 can be associated with the edge region 16 of the barrier 10 in any suitable manner. For instance, the cord-like member 20 can be attached to the barrier 10, such as by bonding, sewing, fasteners, adhesives or mechanical engagement, just to name a few possibilities. In one arrangement, the cord-like member 20 can be enclosed within a pocket 22 formed in an edge regions 16 of the barrier 10. An example of such an arrangement is shown in FIG. 2. The pocket 22 can be formed in any suitable manner, such as by folding over a portion of the main body 11 of the barrier 10 upon itself (as shown in FIG. 2) and/or by the attachment of another piece of material to the main body 11.

In one or more arrangements, the cord-like member 20 can extend continuously along or near at least a portion of a respective side 18 of the barrier 10. The cord-like member 20 can have any suitable cross-sectional shape. In one arrangement, the cord-like member 20 can have a substantially circular cross-sectional shape. However, other cross-sectional shapes are possible. For instance, the cord-like member 20 can have a substantially rectangular, substantially polygonal, substantially triangular, substantially oval, substantially parallelogram, or irregular cross-sectional shape. The cord-like member 20 can have any suitable cross-sectional size. In one arrangement, the cord-like member 20 can be about 5⁄32 inches in diameter.

In one or more implementations, the cord-like member 20 can be a single, continuous structure. Alternatively, the cord-like member 20 can include a plurality of segments. In such case, the plurality of segments can be arranged in a substantially abutted manner. Alternatively, one or more pairs of neighboring segments can be spaced apart from each other.

The cord-like member 20 can be made of any suitable material. In one arrangement, the cord-like member 20 can be made of a material that is resistant to compression. Alternatively or in addition, the cord-like member 20 can be made of a material that allows it to be rolled, unrolled, coiled, uncoiled, folded and/or unfolded.

Again, the cord-like member 20 is merely one example of a bulging element, which, in turn, is merely one way of configuring an edge region 16 of the barrier 10 to be retainably engaged by a retainer element. Thus, it will be understood that embodiments are not limited to these configurations and/or arrangements and that other configurations and/or arrangements are possible.

The edge region 16 can have an associated maximum thickness $T_m$. In the particular arrangement shown in FIG. 2, the maximum thickness $T_m$ is equal to the diameter of the cord-like member 20 plus two times the thickness $T_b$ of the barrier 10, which folded onto itself around the cord-like member 20.

Figure 3:
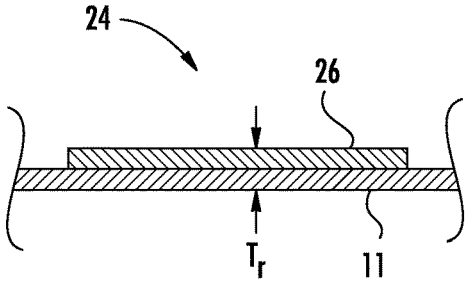
FIG. 3 is a cross-sectional view of an example of a region of increased thickness, viewed along line 3-3 in FIG. 1.

According to arrangements herein, the main body 11 of the barrier 10 can have one or more regions of increased thickness 24 (FIG. 1). The one or more regions of increased thickness 24 can be achieved in any suitable manner. For instance, one or more separate elements can be attached to the main body 11 of the barrier 10, as is shown in FIG. 3. As an example, the one or more separate elements can be one or more separate pieces of material 26. Any suitable form of attachment can be used, such as stitching, adhesives, fasteners, and/or mechanical engagement, just to name a few possibilities. In one or more arrangements, the one or more separate pieces of material 26 can be made of the same material as the main body 11 of the barrier 10. In one or more arrangements, the one or more separate pieces of material 26 can be made of a different material than the main body 11 of the barrier 10. In one or more arrangements, the one or more separate elements can have a thickness that is substantially equal to the thickness of the cord-like member 20.

The region of increased thickness 24 can have an associated thickness $T_r$. In one or more arrangements, the thickness $T_r$ of the one or more regions of increased thickness 24 can be substantially equal to the maximum thickness $T_m$ of one or more edge regions 16 of the barrier 10. However, in some arrangements, the thickness $T_r$ of the one or more regions of increased thickness 24 can be slightly less than the maximum thickness $T_m$ of the edge region 16. Such an arrangement can be provided because of the edge region 16 and, more particularly, the cord-like member 20 of the barrier 10 may not stack evenly when the barrier 10 is rolled up.

Figure 12:
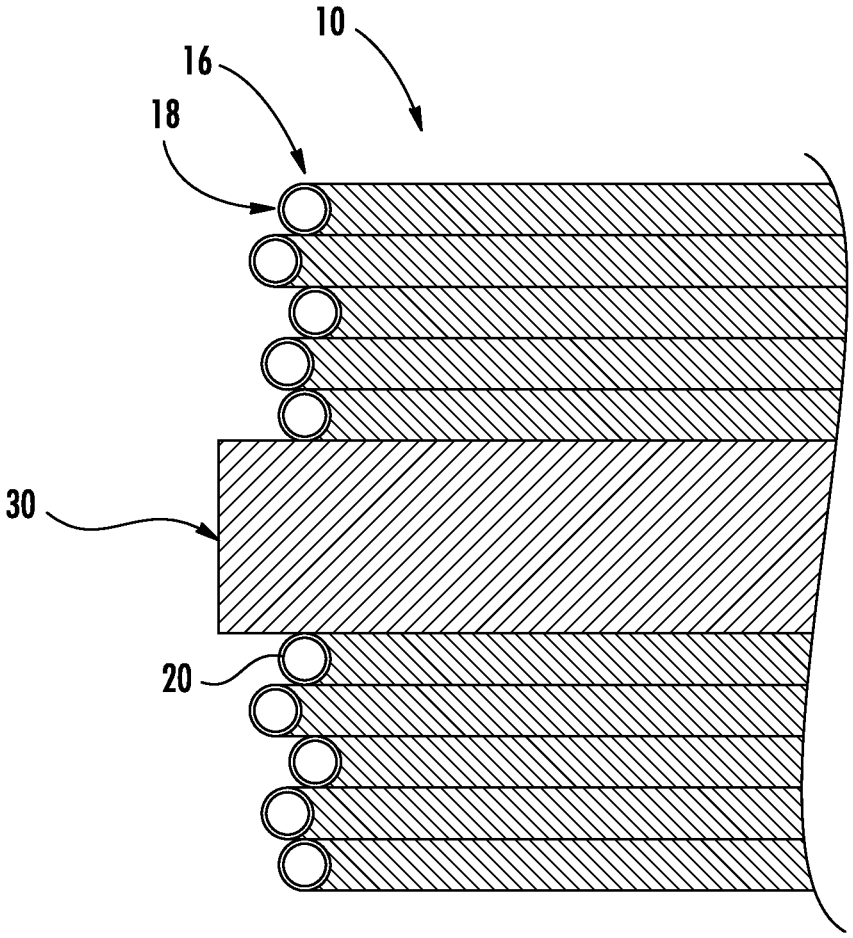
FIG. 12 is a cross-sectional view of a portion of a barrier rolled onto a spindle, showing an edge region of the barrier.

An example of such a condition is shown in FIG. 12 in which a cross-sectional view of a portion of a rolled up barrier 10 is presented. As the barrier 10 is rolled up, the cord-like member 20 can stack upon itself. However, due to various factors, the cord-like member 20 may compress and/or shift slightly in one lateral direction or another. As a result, the stacking of the cord-like member 20 may not be even. Over time, the actual thickness of the stacked edge region 16 can appreciably differ from the theoretical thickness of the stacked edge region. On the other hand, the relatively flat cross-sectional geometry of the region of increased thickness 24 is more conducive to even stacking as the barrier 10 is rolled up. To account for such differences, the thickness $T_r$ of the region of increased thickness 24 can, in at least some arrangements, be slightly less than the maximum thickness $T_m$ of the edge region 16 to ensure that the thickness of the stacked region of increased thickness 24 is more closely matched to the thickness of the stacked edge region when the barrier is at least partially rolled up.

The one or more regions of increased thickness 24 can be provided on the barrier 10 in any suitable location. For instance, one or more regions of increased thickness 24 can be located on the outer side 12 and/or the inner side 14 of the barrier 10. In some instances, the one or more regions of increased thickness 24 can be provided in a central region of the barrier 10, as is shown in FIG. 1. Alternatively or in addition, the one or more regions of increased thickness 24 can be located in a non-central region. As a result, such a region of increased thickness 24 may be located closer to one of the sides 18 of the barrier 10.

The one or more regions of increased thickness 24 can extend in any suitable direction on the barrier 10. For instance, the one or more regions of increased thickness 24 can extend substantially parallel to at least one of the sides 18 of the barrier 10. More particularly, the one or more regions of increased thickness 24 can extend substantially parallel to at least one of the edge regions 16 that is configured to be retainably engaged by a retainer element.

The one or more regions of increased thickness 24 can have any suitable width. The one or more regions of increased thickness 24 can have any suitable length. In one or more arrangements, the one or more regions of increased thickness 24 can extend along substantially the entire length of the barrier 10.

Providing the one or more regions of increased thickness 24 can help to minimize the unappealing appearance of bunching, waviness and/or unevenness that can occur when a barrier 10 with thicker lateral edge regions 16 (e.g. due to the provision of the cord-like member 20) is rolled up for storage. When the barrier 10 is used over large widths, the one or more regions of increased thickness 24 can be provided in any suitable location to minimize the previously noted bunching, waviness and/or unevenness. For instance, the one or more regions of increased thickness 24 can be provided at regular or irregular intervals. In one implementation, the one or more regions of increased thickness 24 can be provided at about every 8 feet of the barrier 10. In one implementation, a region of increased thickness 24 can be provided for every 8 foot span of the barrier 10.

In arrangements including a plurality of regions of increased thickness 24, the regions 24 can be substantially identical to each other. Alternatively, in arrangements including a plurality of regions of increased thickness 24, one or more of the regions of increased thickness 24 can be different from the other regions of increased thickness 24 in at least one respect, including, for example, material, length, width, and/or thickness, just to name a few possibilities.

Figure 4:
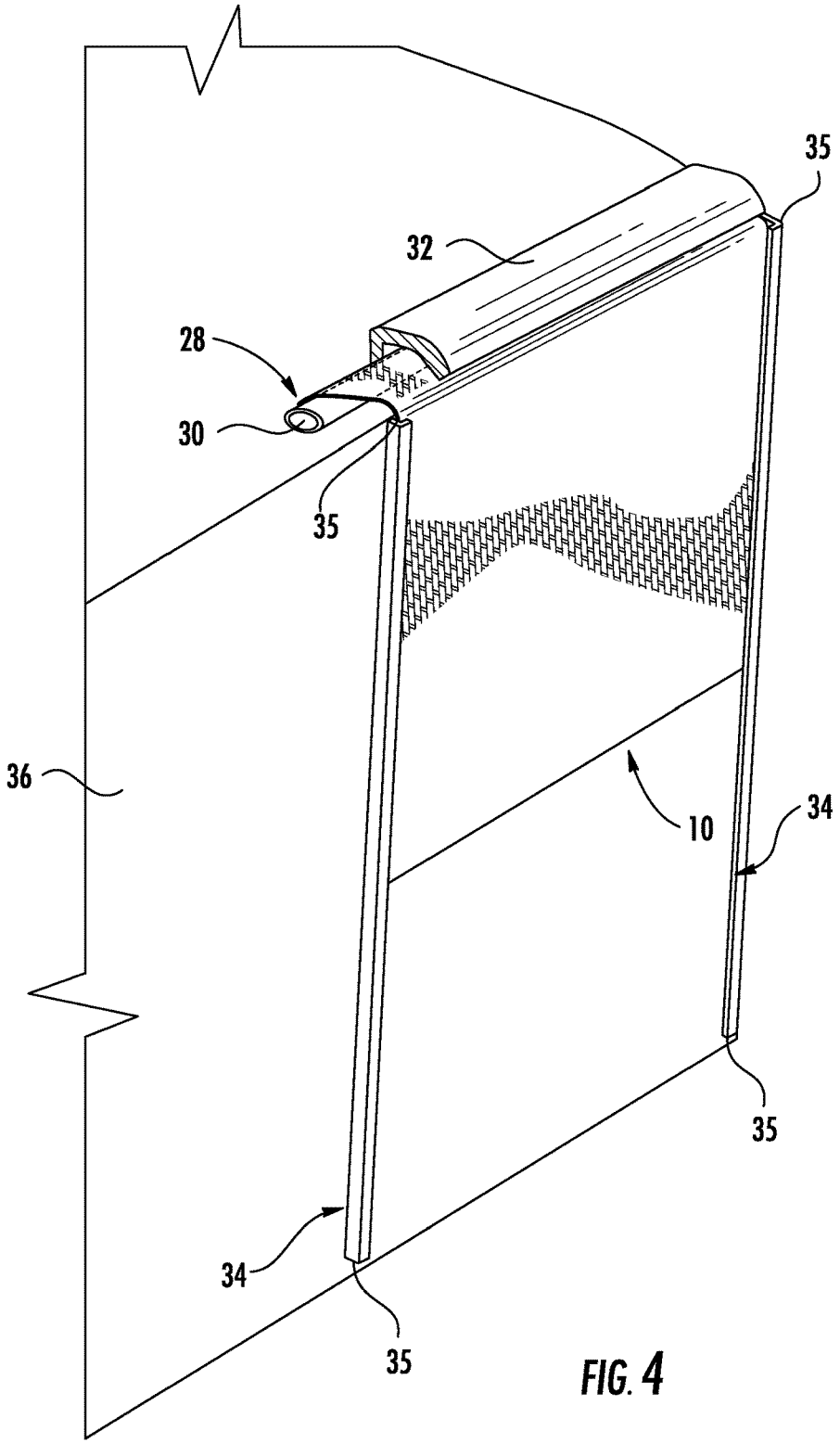
FIG. 4 is an example of a barrier system.

In some arrangements, the barrier 10 can be configured to be deployed and stored in a rolled manner. To that end, one of the sides 18 and/or one of the edge regions 16 of the barrier 10 can be attached to a spindle 30, as is shown in FIG. 4. For instance, one of the sides 18 and/or one of the edge regions 16 of the barrier 10 that is not a part of an edge region 16 that is configured to be retainably engaged by a retainer element can be attached to a spindle 30. The spindle 30 can be mounted directly or indirectly on a portion of the structure. In some instances, the spindle 30 can be located above the portion of the structure being protected; however, other locations are possible. Rolling and unrolling of the barrier 10 from the spindle 30 can be done in any suitable manner, such as manually or in any automated or motorized manner. Examples of a spindle and its use are described in U.S. Pat. Nos. 8,082,970; and 8,505,263, which are incorporated herein by reference.

An edge region 16 and/or an associated side 18 of the barrier 10 that is opposite to the side 18 and/or edge region 16 that that is attached to the spindle 30 can, in some instances, be configured for attachment to the structure being shielded and/or one or more other suitable attachment points. Such attachment can be achieved in any suitable manner, such as by using one or more fasteners, one or more strap and buckle arrangements, and/or one or more forms of mechanical engagement, just to name a few possibilities.

A housing 32 can be provided into which the barrier 10 can be received when being stored or when partially unrolled or deployed. The housing 32 can have any suitable construction and can be made of any suitable material. Further, the housing 32 can protect the barrier 10 from the environment outside of the housing 32. The housing 32 can cover at least a portion of the spindle 30.

The barrier 10 can be attached, secured, retained and/or anchored by either direct fastening to a structure (e.g. the walls of a structure, the floor, the ground, etc.) or by indirectly fastening to a structure by the use of one or more fasteners and/or one or more retainers elements. In one or more arrangements, the barrier 10 can be retained in place by at least two retainer elements. In one or more arrangements, two retainer elements can be provided on opposite sides of a portion of an area to be shielded. More particularly, opposing edge regions 16 of the barrier 10 can be retainably engaged by retainer elements. The retainer elements can be attached to the inside or the outside of the structure. In one or more arrangements, one side of the barrier 10 can be retainably engaged by a retainer element, and an opposite side of the barrier 10 can be attached to any suitable structure using a different manner of attachment, such as by using one or more fasteners, one or more strap and buckle arrangements, and/or one or more forms of mechanical engagement, just to name a few possibilities.

When a retainer element is used, the retainer elements can be oriented in any suitable manner. For instance, the retainer elements can be oriented substantially vertically, substantially horizontally, or in any other orientation. When a plurality of retainer elements are used, the retainer elements can be substantially parallel to each other. Alternatively, one or more of the retainer elements can be oriented transverse to one or more of the other retainer elements.

Figure 5:
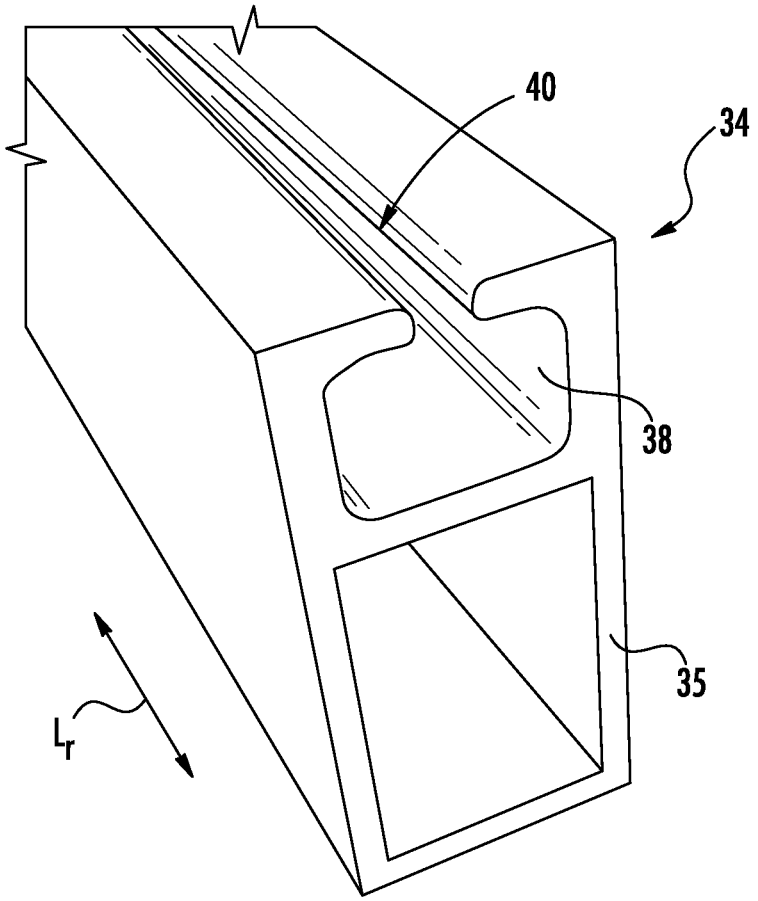
FIG. 5 is an example of a portion of a retainer.

The retainer elements can have any suitable configuration. One example of a retainer 34 is shown in FIG. 5. Additional examples are described in U.S. Pat. Nos. 6,176,050; 6,325,085; 6,886,299; 6,865,852; 8,393,055; 8,082,970; and 8,505,263 and U.S. Patent Application Publication Nos. 2005/0279465 and 2013/0186008, which are incorporated herein by reference. The retainer 34 can have an elongated body and an associated longitudinal direction Lr. The retainer 34 can include a cavity 38 to receive at least a portion of a respective edge region 16 of the barrier 10. The cavity 38 can have any suitable size and/or cross-sectional shape. For instance, the cavity 38 can be substantially circular, substantially rectangular, or substantially polygonal, just to name a few possibilities. The cavity 38 can extend in the longitudinal direction of the retainer 34. The retainer 34 can have opposing longitudinal ends 35 (only one of which is visible in FIG. 5).

The cavity 38 can be in communication with the outside of the retainer 34. For instance, the retainer 34 can include an opening 40. The opening 40 can extend in the longitudinal direction of the retainer 34. The opening 40 can have any suitable configuration. The opening 40 can have an associated width Wo. The width Wo of the opening 40 can be sized to permit a portion of the barrier 10, such as the main body 11, to pass therethrough. In some arrangements, the width Wo of the opening 40 can be sized to prevent the edge region 16 of the barrier 10 from passing therethrough. To that end, the width Wo of the opening 40 can be smaller than the maximum thickness $T_m$ of the edge region 16 and to account for any compression of the edge region 16 that may occur. In some instances, the width of the opening 40 can be smaller than the thickness of the bulging element 19 and, more particularly, the cord-like member 20.

However, it should be noted that, in one or more arrangements, the width Wo of the opening 40 can be substantially equal to and/or greater than the maximum thickness $T_m$ of the edge region 16. In some instances, the width Wo of the opening 40 can be substantially equal to and/or greater than the thickness of the bulging element 19 and, more particularly, the thickness of the cord-like member 20. In one or more implementations, the width Wo of the opening 40 can be about ¼ inch, about ⅙ inch or about ⅛ inch, just to name a few possibilities.

In some arrangements, a single retainer 34 may be used on one side of the area being shielded by the barrier 10. In other arrangements, a pair of retainers 34 can be used and can be arranged on opposite sides of an area being shielded by the barrier 10. In such case, the retainers 34 can be arranged so that the openings 40 are oriented generally toward each other. However, other orientations of the openings 40 are possible. For instance, the openings 40 can be oriented in opposite directions or each other or in one or more transverse directions to each other.

The retainers 34 can be secured to the structure 36 in any suitable manner, such as by one or more fasteners, mechanical engagement, adhesives and/or other means. Further examples of manners in which the retainers can be secured are described in U.S. Pat. Nos. 6,176,050; 6,325,085; 6,886,299; 6,865,852; 8,393,055; 8,082,970; and 8,505,263 and U.S. Patent Application Publication Nos. 2005/0279465 and 2013/0186008, which are incorporated herein by reference.

Figure 11:
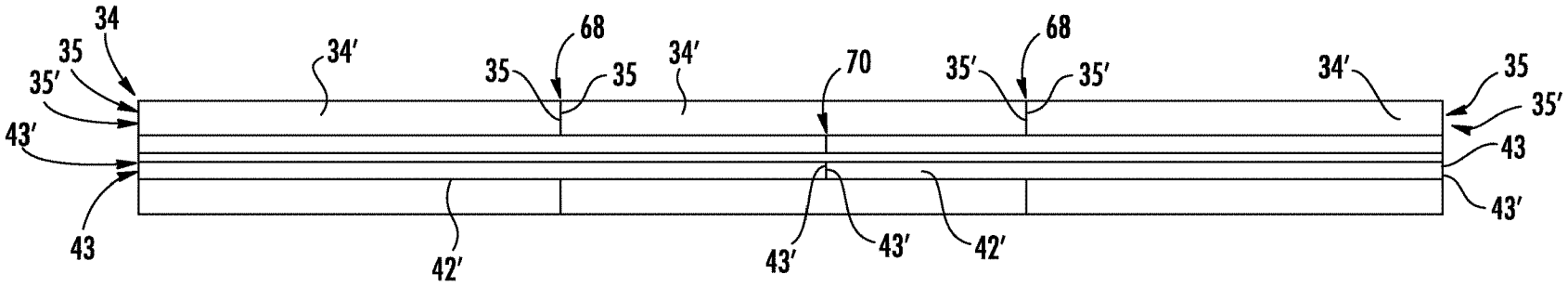
FIG. 11 is a view of an arrangement in which a retainer includes a plurality of retainer segments and an insert includes a plurality of insert segments.

In some instances, a retainer 34 can include a plurality of retainer segments 34' (FIG. 11). As an example, if an area being shielded by the barrier 10 is longer than the length of the retainer 34, then a plurality of retainer segments 34' can be provided to span the area. In such case or in other instances, the plurality of retainer segments 34' can be attached to the structure. In such case or in other instances, the plurality of retainer segments 34' can be arranged in an aligned manner so as to collectively form a retainer 34. "In an aligned manner" means that the respective cavities 38 and openings 40 of the plurality of retainer segments 34' are substantially aligned with each other. In one or more arrangements, the plurality of retainer segments 34' can be substantially abutted such that the longitudinal ends 35' of neighboring pairs of retainer segments 34' directly contact each other or have a minimal spacing between them. In such case, the retainer segments 34' may or may not be attached to each other. In one or more arrangements, one or more pairs of neighboring retainer segments 34' can be arranged in an aligned manner, but the longitudinal ends 35' can be spaced from each other such that a gap is formed between them.

The plurality of retainer segments 34' can be substantially identical to each other. Alternatively, one or more of the plurality of retainer segments 34' can differ from the other retainer segments 34' in one or more respects. In one or more implementations, the plurality of retainer segments 34' can have substantially the same length. In one or more implementations, one or more of the plurality of retainer segments 34' can have a length that is different from the other retainer segments 34'.

The retainers 34 can be made of any suitable material. In one implementation, the retainers 34 can be made of aluminum or hard plastic. The retainers 34 can be made in any suitable manner, such as by extrusion. The opening 40 can be formed in any suitable manner, such as during the extrusion process or by machining or cutting (e.g. by a saw, laser, or water jet). The retainers 34 can be provided in any suitable length.

Figure 6:
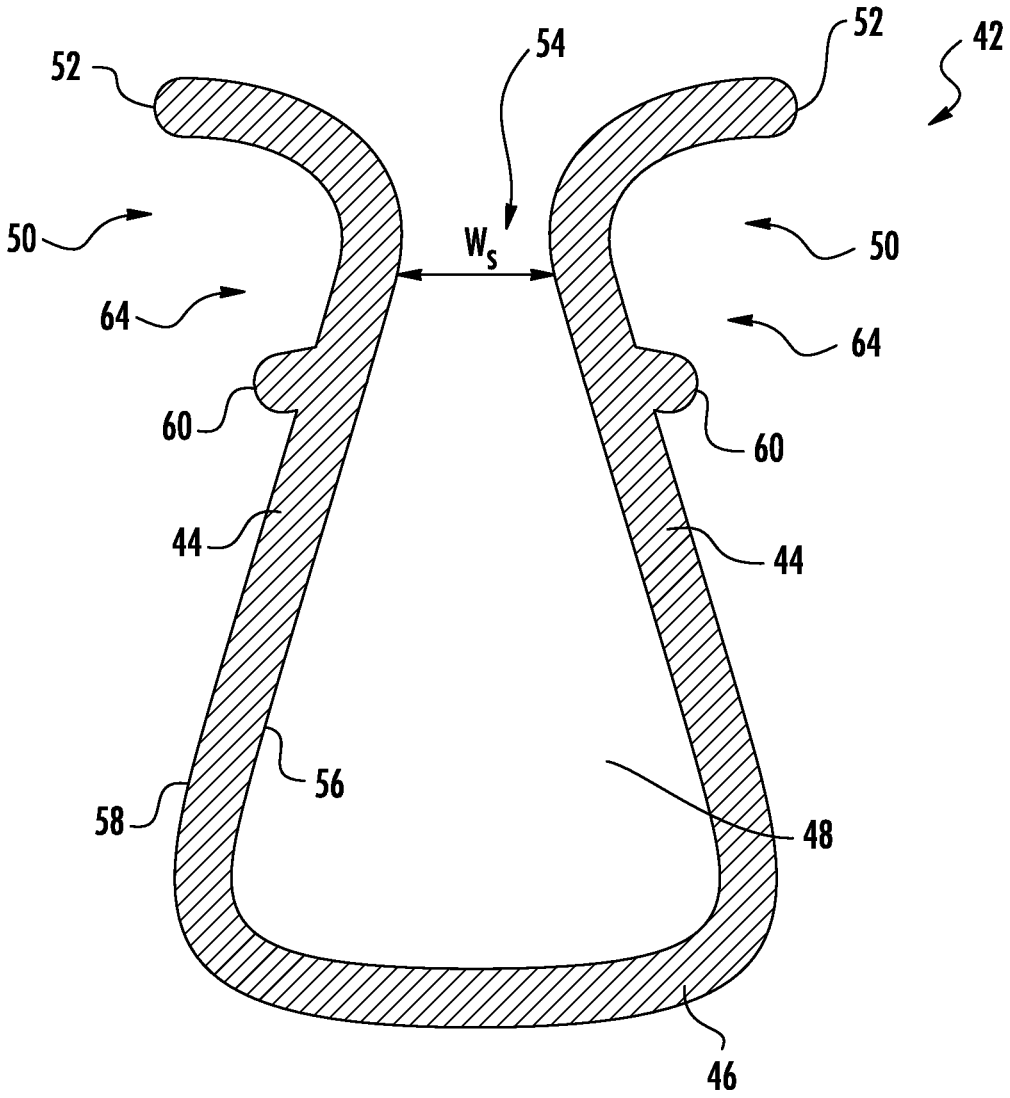
FIG. 6 is a cross-sectional view of an example of an insert.
Figure 7:
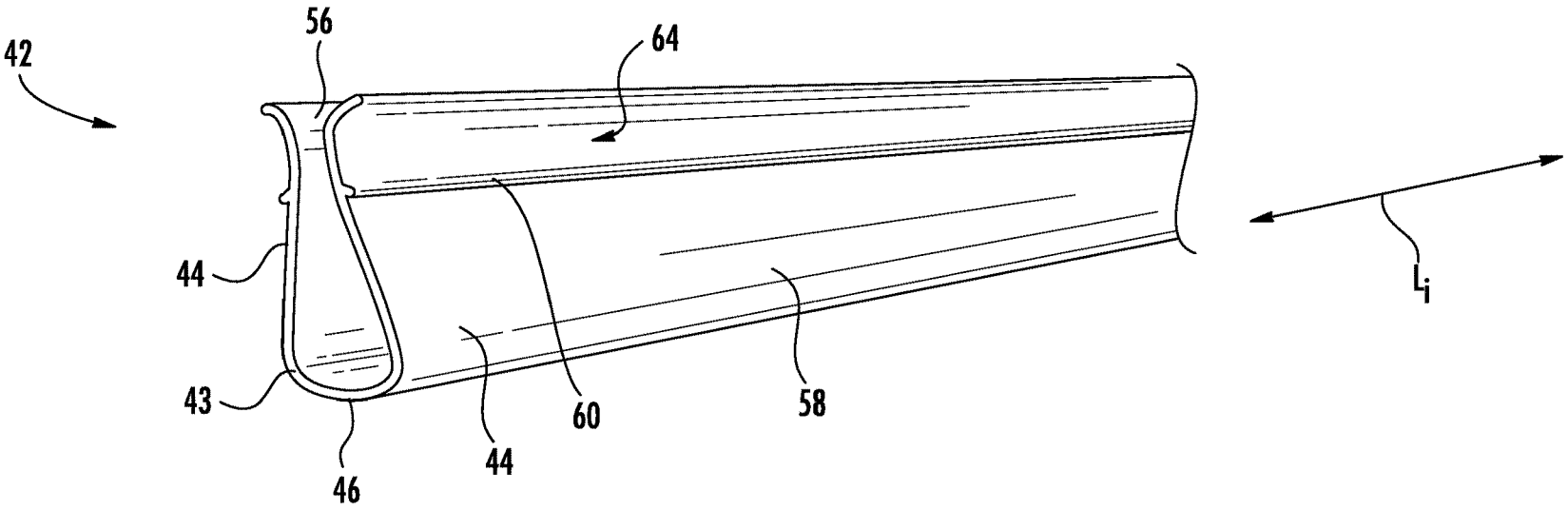
FIG. 7 is a perspective view of an example of a portion of an insert.

According to embodiments herein, an insert 42 can be used in connection with the retainer 34. An example of an insert 42 is shown in FIGS. 6-7. The insert 42 can be configured to be at least partially received in the retainer 34. The insert 42 can also be configured to receive at least a portion of the edge region 16 of the barrier 10 therein.

The insert 42 can have any suitable configuration. In one or more implementations, the insert 42 can have a pair of opposing walls 44. In one or more implementations, the opposing walls 44 can be joined by a bridging portion 46. The bridging portion 46 can have any suitable configuration. In one or more arrangements, the bridging portion 46 can be substantially flat. Alternatively, in one or more arrangements, the bridging portion 46 can be curved. For instance, the bridging portion 46 can be concave or convex. In one or more arrangements, the bridging portion 46 can act as an outward spring on the opposing walls 44. Thus, the opposing walls 44 can be biased outwardly.

The opposing walls 44 can extend from the bridging portion 46 in any suitable manner. The opposing walls 44 can be non-parallel to each other. In one or more arrangements, at least one of the opposing walls 44 can be angled at less than about 90 degrees relative to the bridging portion 46. In one or more arrangements, both of the opposing walls 44 can be angled at less than about 90 degrees relative to the bridging portion 46 such that the opposing walls 44 extend toward each other in a generally converging manner. An example of such an arrangement is shown in FIG. 6. In such case, the insert 42 can have an open triangular configuration. A receiving cavity 48 can be defined at least in part by the opposing walls 44 and the bridging portion 46.

Each of the walls 44 can have a distal end region 50 and terminate at a distal end 52. In some instances, the distal end region 50 and/or the distal end 52 of the walls 44 can be spaced from each other such that a spacing 54 is defined therebetween. The spacing 54 can have an associated width Ws.

In some arrangements, at least one the walls 44 can be generally planar. In other arrangements, at least one of the walls 44 can be curved along at least a portion of its length. In such case, the at least one of the walls 44 can be concave or convex.

In one or more arrangements, the distal end region 50 of at least one of the walls 44 can extend outwardly in a divergent manner from the distal end region 50 of the opposite wall 44. An example of such an arrangement is shown in FIG. 6. In such arrangements, both of the distal end regions 50 of the walls 44 can curve outward in any suitable shape, such as generally c-shaped or substantially u-shaped. The distal end regions 50 can be configured to generally conform to the geometry of the opening 40 of the retainer 34.

The insert 42 can be made of any suitable material. For instance, the insert 42 can be made of plastic or metal. In one implementation, the insert 42 can be made of vinyl.

The insert 42 can be sufficiently rigid, while still permitting some flexibility. For instance, each of the walls 44 can have a bias toward its normal state. Thus, when one or both walls 44 are moved toward each other when a force is applied to them, the walls 44 can return to their normal state when the force is removed. The bridging portion 46 can tend to hold the walls 44 at such an angle that the walls 44 can be moved toward each other to facilitate insertion into the retainer 34.

The insert 42 and/or the retainer 34 can be made of a material that is resistant to ultraviolet radiation, biological degradation, chemical degradation and/or fire. Alternatively or in addition, the insert 42 and/or the retainer 34 can be at least partially coated with one or more materials or substances to provide these and/or other properties.

The insert 42 can be made in any suitable manner. For instance, the insert can be extruded. The insert 42 can be a unitary construction. In some instances, the insert 42 can be made of a plurality of pieces joined together.

The insert 42 can have an inner surface 56 and an outer surface 58. The inner surface 56 can be smooth to facilitate sliding movement of the lateral edge regions 16 of the barrier 10 within the insert 42.

In some arrangements, one or more outer protrusions 60 can be provided on the outer surface 58 of the insert 42, as is shown in FIGS. 6-7. In such case, the outer protrusions 60 can extend outwardly from the outer surface 58. In one or more arrangements, the one or more outer protrusions 60 can be located in or near the distal end region 50 of one or both of the walls 44. The outer protrusion 60 can extend laterally outwardly from the outer surface 58. In some instances, at least one of the outer protrusions 60 can extend generally parallel to the bridging portion 46. The outer protrusions 60 can have any suitable size or shape.

In some arrangements, there can be a single outer protrusion 60 that extends continuously along at least a portion of the length of the retainer 34 on one or both sides thereof. In other arrangements, a plurality of outer protrusion segments (not shown) can be provided along at least a portion of length of the retainer 34. In such arrangements, the plurality of outer protrusions segments can be substantially aligned with each other.

In some arrangements, the outer protrusions 60 and the outer surface 58 of the insert 42 in the respective distal end region 50 can collectively define a channel 64 for receiving a portion of the retainer 34 therein. More particularly, a portion of the retainer 34 defining the opening 40 can be received in the channel 64. Such an arrangement can facilitate alignment with the retainer 34 and can act as a guide.

Figure 8:
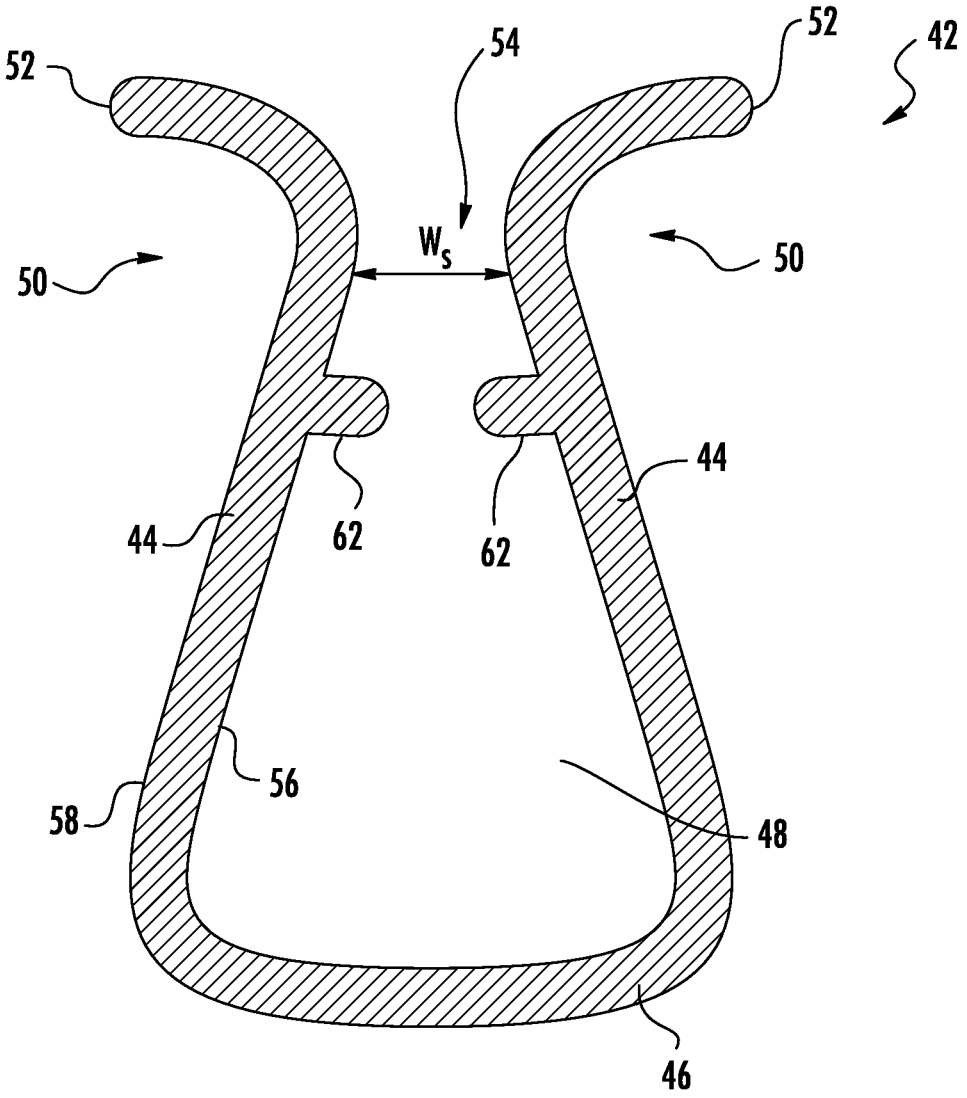
FIG. 8 is a cross-sectional view of an example of an insert, showing protrusions provided on an inner surface of the insert.

In some arrangements, one or more inner protrusions 62 can be provided on the inner surface 56 of the insert 42, as is shown in FIG. 8. In such case, the inner protrusions 62 can extend inwardly from the inner surface 56. In one or more arrangements, the one or more inner protrusions 62 can be located in or near the distal end region 50 of one or both of the walls 44. The inner protrusions 62 can extend laterally inwardly from the inner surface 56. In some instances, at least one of the inner protrusions 62 can be generally parallel to the bridging portion 46. The inner protrusions 62 can have any suitable size or shape.

In some arrangements, there can be a single inner protrusion 62 that extends continuously along at least a portion of the length of the retainer 34 on one or both sides thereof. In other arrangements, a plurality of inner protrusion segments (not shown) can be provided along at least a portion of length of the retainer 34. The plurality of inner protrusions segments can be substantially aligned with each other.

The inner protrusions 62 can help to maintain a minimum spacing 54 between the walls 44 so as to avoid compression of the cord-like member 20. Alternatively or in addition, the inner protrusions 62 can help to keep the cord-like member 20 away from the spacing 54 in the insert 42 so as to minimize the possibility of the lateral edge region 16 of the barrier 10 passing through the spacing 54. Alternatively or in addition, the inner protrusions 62 can also help to avoid interference with the barrier 10 as it slides within the insert 42 when deployed or retracted.

The insert 42 can have an elongated body and an associated longitudinal direction Li. The outer protrusions 60 and/or the inner protrusions 62 can extend in the longitudinal direction Li. The insert 42 can have opposing longitudinal ends 43 (only one of which is visible in FIG. 7).

Figure 13:
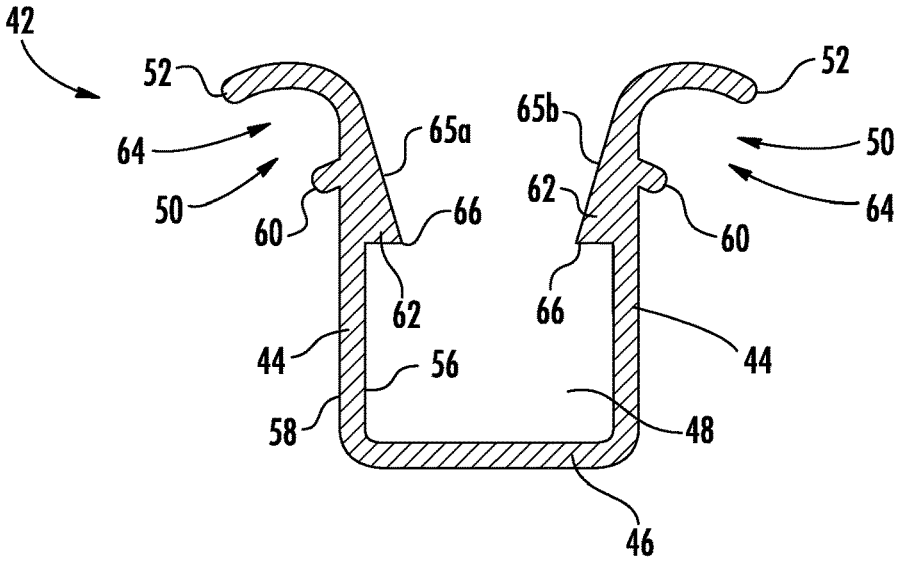
FIG. 13 is a cross-sectional view of an example of an insert having protrusions provided on an inner surface and an outer surface of the insert, and showing the insert in an uninstalled condition.
Figure 14:
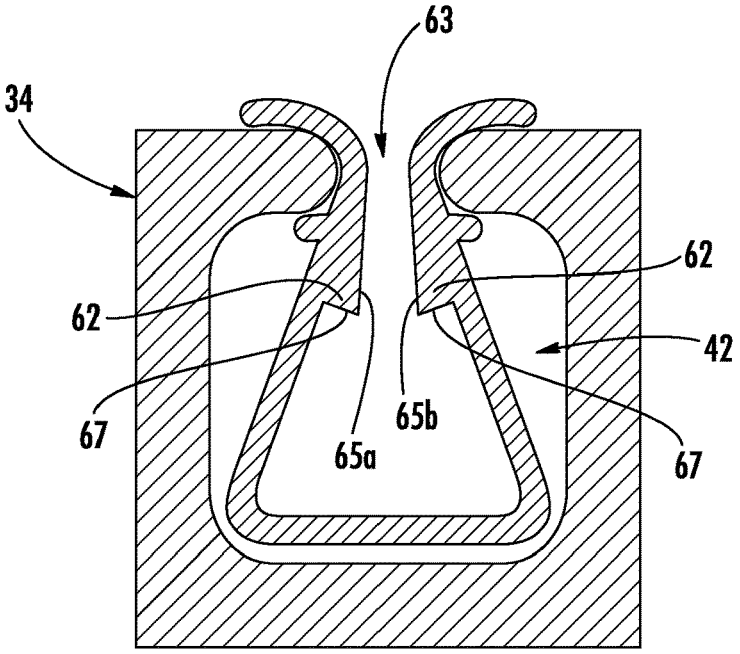
FIG. 14 is a cross-sectional view of an example of an insert having protrusions provided on an inner surface and an outer surface of the insert, and showing the insert in an installed condition.

Another example of an insert 42 is shown in FIGS. 13 and 14. FIG. 13 shows the insert 42 in an uninstalled condition, that is, the insert 42 is not received in the retainer 34. FIG. 14 shows the insert 42 in an installed condition, that is, the insert 42 is at least partially received in the retainer 34. In the arrangement shown in FIGS. 13-14, the insert 42 can have both outer protrusions 60 and inner protrusions 62. However, embodiments are not limited to this arrangement. Indeed, in other arrangements, the insert 42 can have only outer protrusions 60 or only inner protrusions 62.

The above description of the insert 42 in connection with FIGS. 6 and 8 with respect to various features or aspects of the insert can apply equally here with respect to the insert shown in FIGS. 13-14. Further, in the arrangement shown, the inner protrusions 62 can be generally triangular in cross-sectional shape. When one or both walls 44 are moved toward each other, such as to the position shown in FIG. 14, a passage 63 can be defined between opposing guide surfaces 65*a*, 65*b* of the inner protrusions 62 due to their configuration. The passage 63 can be elongated. In one or more arrangements, the guide surfaces 65*a*, 65*b* can be substantially parallel to each other when the insert 42 is received in the retainer 34, as is shown in FIG. 14. The width of the passage 63 can be substantially constant.

For the configuration shown in FIGS. 13 and 14, as well as in other similar configurations, the inner protrusions 62 can have a corner 66. The corner 66 can be rounded or otherwise dulled. In this way, sharp corners can be avoided. Further, the possibility of cutting or wear of any portion of the barrier 10, including the cord-like member 20, can be minimized. Further, for the configuration shown in FIGS. 13 and 14, the inner protrusions 62 can includes surfaces 67 that form ledges. In one or more arrangements, a portion of the barrier 10 located within the insert 42 can be supported on the ledges.

It should also be noted that the insert 42 can have a bias toward a normal state of the walls 44 is shown in FIG. 13. In such case, the walls 44 can be substantially parallel to each other. However, the insert 42 is not limited in these respects, as the configuration of the insert 42 shown in FIGS. 13 and 14 is provided merely as one non-limiting example.

Figure 9:
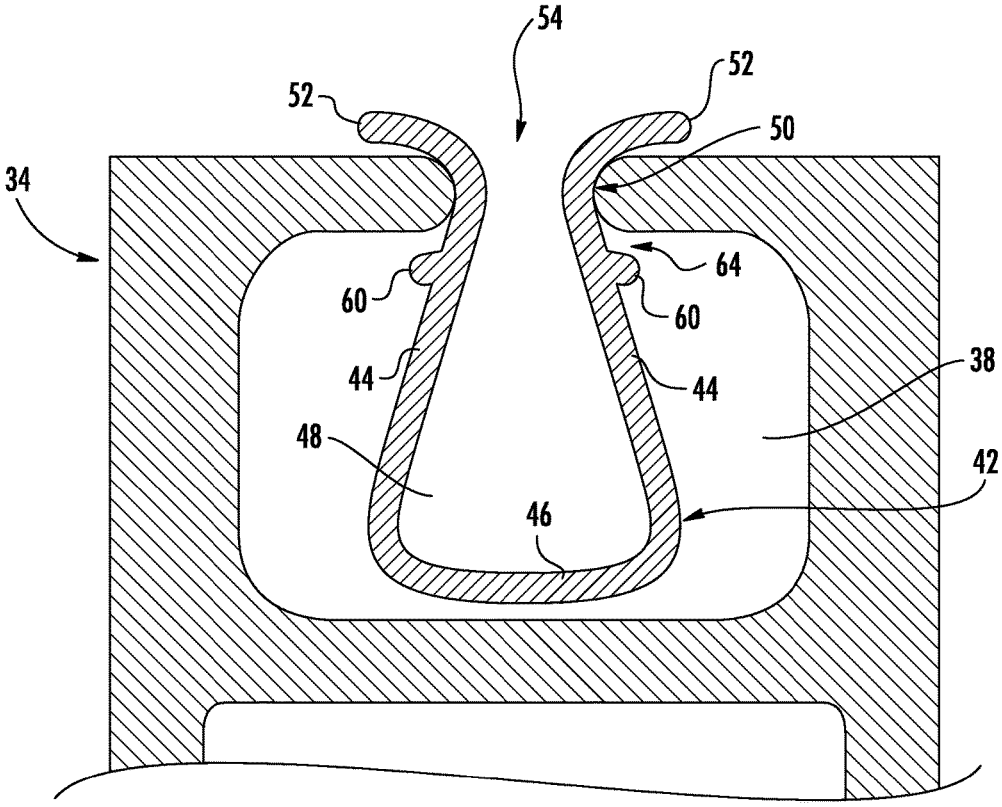
FIG. 9 is a cross-sectional view of an example of an arrangement in which a portion of an insert is received in a retainer.

The one or more retainers 34 can be attached to a structure 36 in any suitable manner, including, for example, one or more fasteners, mechanical engagement, and/or adhesives, just to name a few possibilities. Other examples of such attachment are described in U.S. Pat. Nos. 6,176,050; 6,325,085; 6,886,299; 6,865,852; 8,393,055; 8,082,970; and 8,505,263 and U.S. Patent Application Publication Nos. 2005/0279465 and 2013/0186008, which are incorporated herein by reference. The insert 42 can be brought to an end 35 of the retainer 34. A substantial portion of the insert 42 can be slid into the cavity 38 of the retainer 34, and the distal end region 50 of the walls 44 can pass through the spacing 54. The walls 44 can be moved toward each other to facilitate insertion into the retainer 34. An example of an arrangement of the insert 42 in the retainer 34 is shown in FIG. 9.

Figure 10:
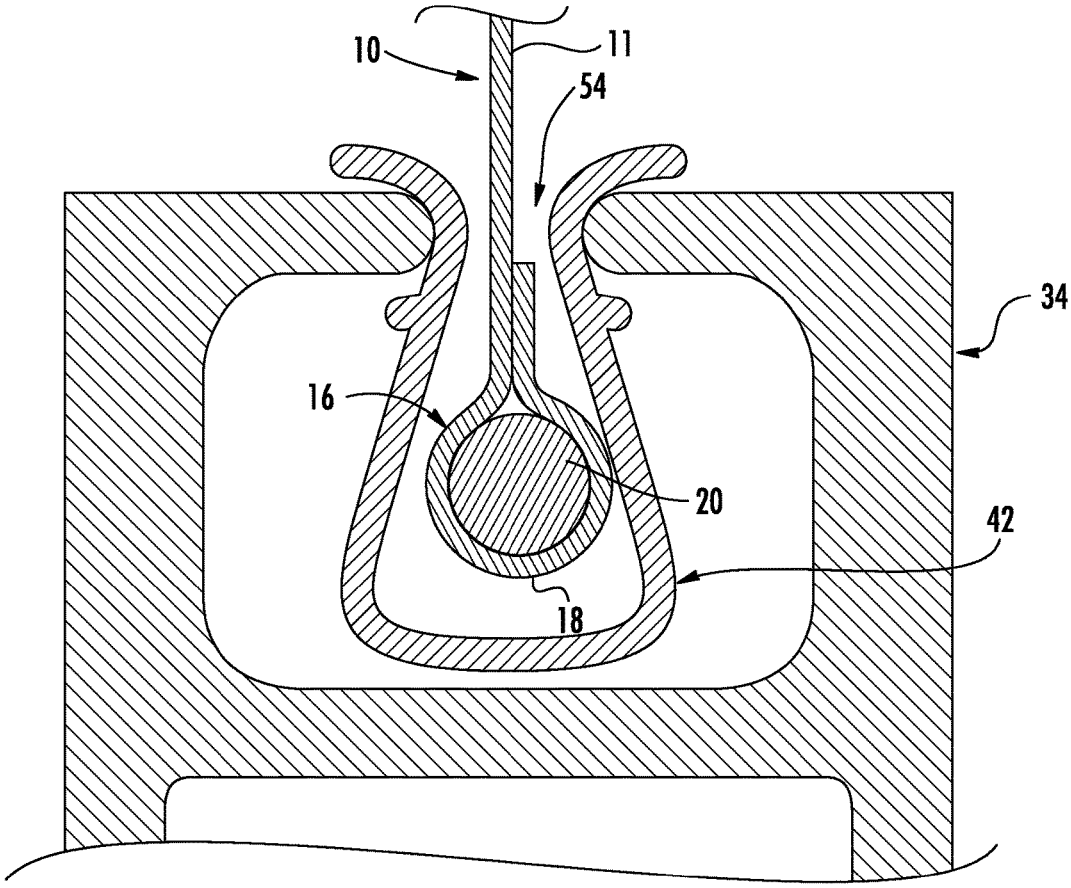
FIG. 10 is a cross-sectional view of an example of an arrangement in which a portion of an insert is received in a retainer and in which a portion of a barrier is received in the insert.

A portion of the barrier, such as at least a portion of one of the edge regions 16 of the barrier 10, can be slid into the receiving cavity 48 of the insert 42. The rest of the barrier 10 can extend outside of the insert 42 through the spacing 54 between the walls 44. An example of such an arrangement is shown in FIG. 10. The same process can be used to insert the opposite lateral edge region 16 of the barrier 10 into the insert 42 of an opposing retainer 34. The barrier 10 can be slid along the inserts 42. The diameter of the cord-like member 20 can be less than the size of the opening 40 in the retainer 34.

In one or more implementations, the retainer 34 can be made of a plurality of retainer segments 34', as may occur, for example, when shielding large areas of a structure. An example of such an arrangement is shown in FIG. 11. The ends 35' of neighboring retainer segments 34', which may be substantially abutted end to end 35' (as explained above) or spaced apart. The neighboring retainer segments 34' can form a retainer segment junction 68. The retainer segment junction 68 can be defined by between the abutting ends 35' and/or by the spacing between the ends 35'. In some instances, each retainer segment 34' can be attached to a neighboring retainer segment 34' in any suitable manner. The plurality of retainer segments 34' can have substantially the same length, or one or more of the plurality of retainer segments 32' can have a length that is different from the other retainer segments 32'.

In one or more implementations, the insert 42 can be made of a plurality of insert segments 42'. In such case, the plurality of insert segments 42' can be arranged in a substantially aligned manner. "In an aligned manner" means that the respective receiving cavities 48 and spacings 54 of the plurality of insert segments 42' are substantially aligned with each other. In one or more arrangement, the plurality of insert segments 42' can be substantially abutted such that the ends 43' of neighboring pairs of insert segments 42' directly contact each other or have a minimal spacing between them. The substantially abutting ends 43' of the insert segments 42' can form an insert segment junction 70.

The plurality of insert segments 42' can be substantially identical to each other. Alternatively, one or more of the plurality of insert segments 42' can differ from the other insert segments 42' in one or more respects. In one or more implementations, the plurality of insert segments 42' can have substantially the same length. In one or more implementations, one or more of the plurality of insert segments 42' can have a length that is different from the other insert segments 42'.

It should be noted that arrangements herein can include any suitable combination of the various configurations for the retainer 34 and the insert 42. As an example, the retainer 34 can be a single piece, and the insert 42 can be a single piece. As another example, the retainer 34 can be a single piece, and the insert 42 can be made of a plurality of insert segments 42'. As a further example, the retainer 34 can be made of a plurality of retainer segments 34', and the insert 42 can be a single piece. As a still further example, the retainer 34 can be made of a plurality of retainer segments 34', and the insert 42 can be made of a plurality of insert segments 42'.

When the retainer 34 is made of a plurality of retainer segments 34', the insert 42 and/or the retainer segments 34' can be arranged so that the insert 42 spans across one or more retainer segment junctions 68. Likewise, the insert segments 42' and/or the retainer segments 34' can be arranged so that an insert segment 42' spans across one or more retainer segment junctions 68. That is, the insert segment junctions 70 can be offset from the retainer segment junctions 68. Such offsetting can be achieved in any suitable manner. In one implementation, the retainer segments 34' can have a different length than the insert segments 42'. For instance, such an arrangement can be attained by providing an insert segments 42' that are longer than the retainer segments 34'. Alternatively, the opposite arrangement can be provided in which the retainer segments 34' are longer than the insert segments 42'. In another implementation, the retainer segments 34' can have substantially the same length as the insert segments 42', but the retainer segments 34' and the insert segments 42' are arranged so that the insert segment junctions 70 are offset from the retainer segment junctions 68.

Regardless of whether the inserts 42 and/or the retainers 34 are made of a single piece or a plurality of segments, the overall length of the inserts 42 and the retainers 34 can be substantially the same. As such, the insert 42 does not extend substantially beyond the ends 35 of the retainer 34.

It will be appreciated that, as a result of arrangements described herein, one or more of the following benefits and/or other benefits can be realized. For instance, the use of an insert can allow a barrier with a thinner edge region to be used. More particularly, the use of an insert can allow an end region with a smaller diameter cord-like member (or other bulging element) to be used. Still more particularly, the use of an insert can allow the diameter of the cord-like member to be smaller than the width of the opening in the retainer to be used. As a result, problems with uneven rolling and unrolling of the cord, and the associated unsightly appearance and misalignment problems, can be reduced. Of course, a smaller cord-like member can also decrease the weight and/or cost of the barrier.

In addition, the retainer and the opening in the retainer can be formed using cost effective manufacturing methods. For instance, the retainer and the cavity can be formed by extrusion, and the opening can be formed by a suitable cutting operation. Because the width of the opening can greater than the maximum thickness of the edge region (or the diameter of the cord-like member), less expensive blades or other cutting methods are available. Further, the insert prevents the cord and the associated portion of the barrier from slipping out of the retainer.

Further, as noted above, the one or more regions of increased thickness can help to minimize the unsightly appearance of bunching, waviness and/or unevenness that can occur when a barrier with thicker lateral edge regions 16 (e.g. due to the provision of the cord) compared to the rest of the barrier is rolled up for storage.

Moreover, the size of the housing can be reduced because a smaller cord is used compared to prior designs. It is estimated that the size of the housing can be reduced from about 14 percent to about 50%. Such a reduction in size can provide numerous benefits, as the housing weighs less, is less bulky and provides a less intrusive appearance.

Still further, by providing inserts that span across retainer segment junctions, the possibility the barrier snagging or catching at such junctions during deployment or retraction of the barrier can be avoided. Further, the provision of an insert in the retainer, particularly when the retainer includes a plurality of retainer segments, can ensure that the proper alignment of the retainer segments is achieved.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language).

Aspects described herein can be embodied in other forms and combinations without departing from the spirit or essential attributes thereof. Thus, it will of course be understood that embodiments are not limited to the specific details described herein, which are given by way of example only, and that various modifications and alterations are possible.

What is claimed is:

1. A barrier comprising:

a main body, a first edge region and a second edge region, the first edge region defining a first side of the barrier, the first edge region including a first bulging element, the first edge region having an associated maximum thickness, the second edge region defining a second side of the barrier, the second edge region including a second bulging element, the first edge region and the second edge region being on opposite sides of the barrier and extending substantially parallel to each other, the main body of the barrier including one or more regions of increased thickness, the one or more regions of increased thickness being in an intermediate location between the first bulging element and the second bulging element, the one or more regions of increased thickness being spaced from the first edge region and the second edge region, the one or more regions of increased thickness not contacting the first bulging element or the second bulging element, the one or more regions of increased thickness being non-inflatable, the one or more regions of increased thickness having an associated thickness, the thickness of the one or more regions of increased thickness being substantially equal to or less than the maximum thickness of the first edge region, the one or more regions of increased thickness being defined by one or more separate elements attached to one of an inner side or an outer side of the main body, the one or more separate elements being made of the same material as the main body, the main body, the first bulging element, and the second bulging element being configured to be rolled.

2. The barrier of claim 1, wherein the one or more separate elements are attached to only one of the inner side or the outer side of the main body.

3. The barrier of claim 1, wherein the one or more regions of increased thickness extend in a direction that is substantially parallel to at least one of the first side or the second side of the barrier.

4. The barrier of claim 3, wherein the one or more regions of increased thickness extend at least a majority of a length of the barrier in the direction that is substantially parallel to at least one of the first side or the second side of the barrier.

5. The barrier of claim 1, wherein the main body having an associated width, wherein the one or more regions of increased thickness has an associated width, and wherein the width of the one or more regions of increased thickness is less than about 50% of the width of the main body.

6. A barrier system comprising:

a spindle having a longitudinal axis, the spindle being rotatable about the longitudinal axis; and a barrier having a main body, a first edge region and a second edge region, the first edge region defining a first side of the barrier, the first edge region including a first bulging element, the first edge region having an associated maximum thickness, the second edge region defining a second side of the barrier, the second edge region including a second bulging element, the first edge region and the second edge region being on opposite sides of the barrier and extending substantially parallel to each other, the main body of the barrier including one or more regions of increased thickness, the one or more regions of increased thickness being in an intermediate location between the first bulging element and the second bulging element, the one or more regions of increased thickness being spaced from the first edge region and the second edge region, the one or more regions of increased thickness not contacting the first bulging element or the second bulging element, the one or more regions of increased thickness being non-inflatable, the one or more regions of increased thickness having an associated thickness, the thickness of the one or more regions of increased thickness being substantially equal to or less than the maximum thickness of the first edge region, the one or more regions of increased thickness being defined by one or more separate elements attached to one of an inner side or an outer side of the main body, the one or more separate elements being made of the same material as the main body, a portion of the barrier being attached to the spindle, the barrier being configured to be selectively rolled onto or rolled from the spindle, whereby, in a stored configuration, the barrier is rolled onto the spindle, and whereby, in a deployed configuration, at least a portion of the barrier is unrolled from the spindle.

7. The barrier system of claim 6, wherein, in the deployed configuration, the at least a portion of the barrier that is unrolled from the spindle extends downwardly in a substantially vertical direction from the spindle.

8. The barrier system of claim 6, wherein the main body includes a third edge region defining a third side of the barrier, wherein the third side is transverse to the first side and the second side, and wherein the third side or the third edge region is attached to the spindle.

9. The barrier system of claim 6, wherein the main body having an associated width, wherein the one or more regions of increased thickness has an associated width, and wherein the width of the one or more regions of increased thickness is less than about 50% of the width of the main body.

10. The barrier system of claim 6, wherein the one or more regions of increased thickness extend in a direction that is substantially parallel to at least one of the first side or the second side of the barrier.

11. The barrier system of claim 6, wherein the one or more regions of increased thickness extend at least a majority of a length of the barrier in a direction that is substantially parallel to at least one of the first side or the second side of the barrier.

12. A barrier system comprising:

a retainer having a body including a cavity and an opening, the opening permitting communication between the cavity and the outside of the retainer; and a barrier including:

a main body, a first edge region, and a second edge region, the first edge region defining a first side of the barrier, the first edge region including a first bulging element, the first edge region having an associated maximum thickness, the second edge region defining a second side of the barrier, the second edge region including a second bulging element, the first edge region and the second edge region being on opposite sides of the barrier and extending substantially parallel to each other, the main body of the barrier including one or more regions of increased thickness, the one or more regions of increased thickness being in an intermediate location between the first bulging element and the second bulging element, the one or more regions of increased thickness being spaced from the first edge region and the second edge region, the one or more regions of increased thickness not contacting the first bulging element or the second bulging element, the main body having an associated width, the one or more regions of increased thickness having an associated width, the width of the one or more regions of increased thickness being less than about 50% of the width of the main body, the one or more regions of increased thickness being non-inflatable, the one or more regions of increased thickness having an associated thickness, the thickness of the one or more regions of increased thickness being substantially equal to or less than the maximum thickness of the first edge region, the one or more regions of increased thickness being defined by one or more separate elements attached to one of an inner side or an outer side of the main body, the one or more separate elements being made of the same material as the main body, at least a portion of the first edge region of the barrier including the first bulging element being received in the cavity in the retainer, the barrier passing through the opening in the retainer, whereby the barrier is retainably engaged in the retainer.

13. A barrier system comprising:

a retainer having a body including a cavity and an opening, the opening permitting communication between the cavity and the outside of the retainer;

a barrier including:

a main body, a first edge region, and a second edge region, the first edge region defining a first side of the barrier, the first edge region including a first bulging element, the first edge region having an associated maximum thickness, the second edge region defining a second side of the barrier, the second edge region including a second bulging element, the first edge region and the second edge region being on opposite sides of the barrier and extending substantially parallel to each other, the main body of the barrier including one or more regions of increased thickness, the one or more regions of increased thickness being in an intermediate location between the first bulging element and the second bulging element, the one or more regions of increased thickness being spaced from the first edge region and the second edge region, the one or more regions of increased thickness not contacting the first bulging element or the second bulging element, the main body having an associated width, the one or more regions of increased thickness having an associated width, the width of the one or more regions of increased thickness being less than about 50% of the width of the main body, the one or more regions of increased thickness being non-inflatable, the one or more regions of increased thickness having an associated thickness, the thickness of the one or more regions of increased thickness being substantially equal to or less than the maximum thickness of the first edge region, at least a portion of the first edge region of the barrier including the first bulging element being received in the cavity in the retainer, the barrier passing through the opening in the retainer, whereby the barrier is retainably engaged in the retainer; and an insert having a pair of opposing walls, a spacing being defined between the pair of opposing walls, the insert including a cavity, the insert being at least partially received in the cavity of the retainer, at least a portion of the first edge region of the barrier being received in the cavity in the insert, the barrier passing through the spacing between the pair of opposing walls of the insert and the opening in the retainer, whereby the barrier is retainably engaged in the retainer by the insert.

14. The barrier system of claim 12, wherein the retainer is a first retainer, and further including:

a second retainer having a body including a cavity and an opening, the opening permitting communication between the cavity and the outside of the second retainer, wherein the first retainer and the second retainer are substantially parallel to each other, at least a portion of the second edge region of the barrier including the second bulging element being received in the cavity in the second retainer, the barrier passing through the opening in the second retainer, whereby the barrier is retainably engaged in the second retainer.

15. The barrier system of claim 12, wherein the one or more regions of increased thickness extend in a direction that is substantially parallel to at least one of the first side or the second side of the barrier, and wherein the one or more regions of increased thickness extend at least a majority of a length of the barrier in the direction that is substantially parallel to at least one of the first side or the second side of the barrier.

16. The barrier of claim 1, wherein the main body has an associated thickness, wherein the one or more separate elements have an associated thickness, and wherein the thickness of the main body is substantially equal to the thickness of the of the one or more separate elements.

17. The barrier of claim 1, wherein at least one of the first bulging element and the second bulging element includes one or more cord members.

18. The barrier of claim 1, wherein, in one of the first edge region or the second edge region, a portion of the main body is folded over upon itself to enclose a respective one of the first bulging element or the second bulging element.

* * * * *